US007654859B2

(12) United States Patent
Cheng

(10) Patent No.: US 7,654,859 B2
(45) Date of Patent: Feb. 2, 2010

(54) BATTERY CONNECTING STRUCTURE

(75) Inventor: Da-Qing Cheng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/125,884

(22) Filed: May 22, 2008

(65) Prior Publication Data

US 2009/0233497 A1 Sep. 17, 2009

(30) Foreign Application Priority Data

Mar. 12, 2008 (CN) ..... 2008 1 0300530

(51) Int. Cl.
*H01R 3/00* (2006.01)

(52) U.S. Cl. ..... 439/500; 439/824; 429/54; 429/100

(58) Field of Classification Search ..... 439/500, 439/700, 824; 429/54, 100
See application file for complete search history.

(56) References Cited

U.S. PATENT DOCUMENTS

| | | | | |
|---|---|---|---|---|
| 4,343,325 | A | 8/1982 | Fallon | 137/212 |
| 5,149,598 | A | 9/1992 | Sunshine | 429/1 |
| 5,641,315 | A | 6/1997 | Swart et al. | 439/824 |
| 2005/0026033 | A1 | 2/2005 | Kawano et al. | 429/53 |

*Primary Examiner*—Tho D Ta
(74) *Attorney, Agent, or Firm*—Zhigang Ma

(57) ABSTRACT

An exemplary battery connecting structure includes a housing and a contact spring. The housing includes a base, a sidewall extending around a periphery of the base, and at least one fixing portion defined at an inner surface of the sidewall away from the base. The contact spring includes a plurality of loops. A loop of an end of the contact spring is fixed between the base and the fixing portion, such that the end of the contact spring is electrically fixed to the base of the housing. In the present battery connecting structure, the contact spring is not easily detached from the housing. A battery-powered device using the battery connecting structure is also provided.

17 Claims, 7 Drawing Sheets

BATTERY CONNECTING STRUCTURE

BACKGROUND

1. Field of the Invention

The present invention relates to batteries, more particularly, to a battery connecting structure including a contact spring.

2. Discussion of the Related Art

In battery-powered devices such as wireless keyboards and remote controls, it is necessary to reliably transfer power from a battery to a circuit board or other electronic components. Typically, this is accomplished with a battery connecting structure including a housing and a contact spring electrically fixed to the housing. The battery-powered device includes a battery cavity for receiving the battery. The housing is located at an end of the battery cavity and connected to the circuit board or other electronic components. The contact spring in the housing resists the battery with a resilient force.

Unfortunately, the battery connecting structure suffers from a number of problems and disadvantages. One disadvantage is with the contact spring being connected to the housing by frictional force produced between an inner surface of a sidewall of the housing and an outer portion of the contact spring. This connections between the housing and the contact spring are weak and can fail due to overstraining or jarring, thereby breaking the electrical connection or otherwise adversely affecting operation of the battery-powered device. The housing is typically made of metal materials by punching and drawing processes, thus, a small arcuate angle (about 0.2 millimeters) of a base relative to the sidewall of the housing is usually formed. In order to ensure the friction between the contact spring and the housing, the maximum diameter of the contact spring must be larger than an inner diameter of the housing. Therefore, it is difficult for the contact spring to contact with the base of the housing. Additionally, because the housing is manufactured by punching and drawing processes, the sidewall of the housing is not always perpendicular to the base of the housing, but is typically slanted relative to the base at a maximum angle of about 88 degrees. Thus, the contact spring is prone to be detached from the housing.

What is needed, therefore, is a new battery connecting structure that can overcome the above-mentioned shortcomings.

SUMMARY

A battery connecting structure according to a preferred embodiment includes a housing and a contact spring. The housing includes a base, a sidewall extending around a periphery of the base, and at least one fixing portion defined at an inner surface of the sidewall away from the base. The contact spring includes a plurality of loops. A loop of a distal end of the contact spring is fixed between the base and the fixing portion, such that the distal end of the contact spring is electrically fixed to the base of the housing.

Other advantages and novel features will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present battery connecting structure. Moreover, in the drawings, like reference numerals designate corresponding parts throughout the several views, and all the views are schematic.

DETAILED DESCRIPTION OF THE PREFERRED EMBODIMENTS

Reference will now be made to the drawings to describe preferred embodiments of the present optical plate and battery connecting structure, in detail.

Figure 1:
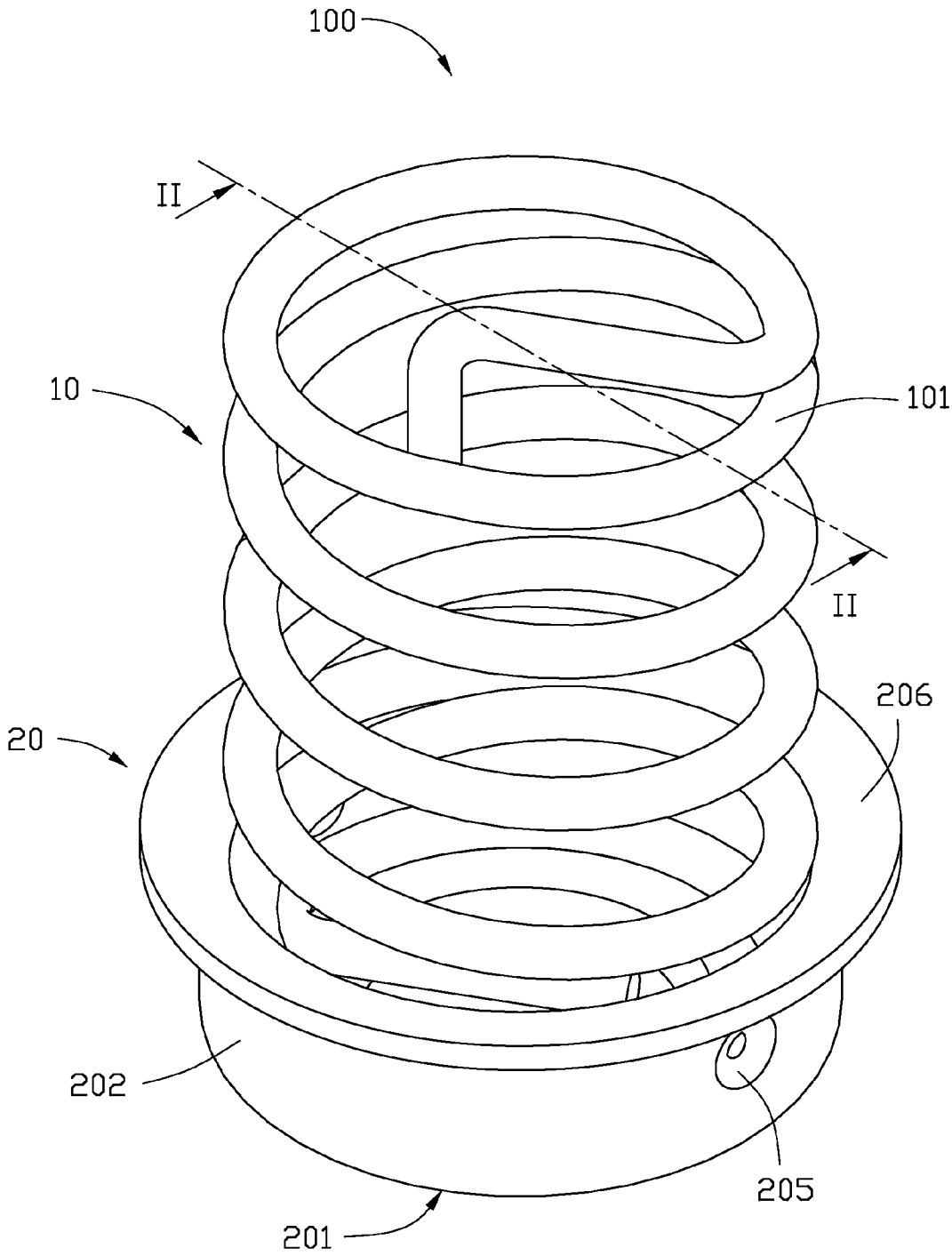
FIG. 1 is an isometric view of a battery connecting structure according to a first exemplary embodiment of the present invention.
Figure 2:
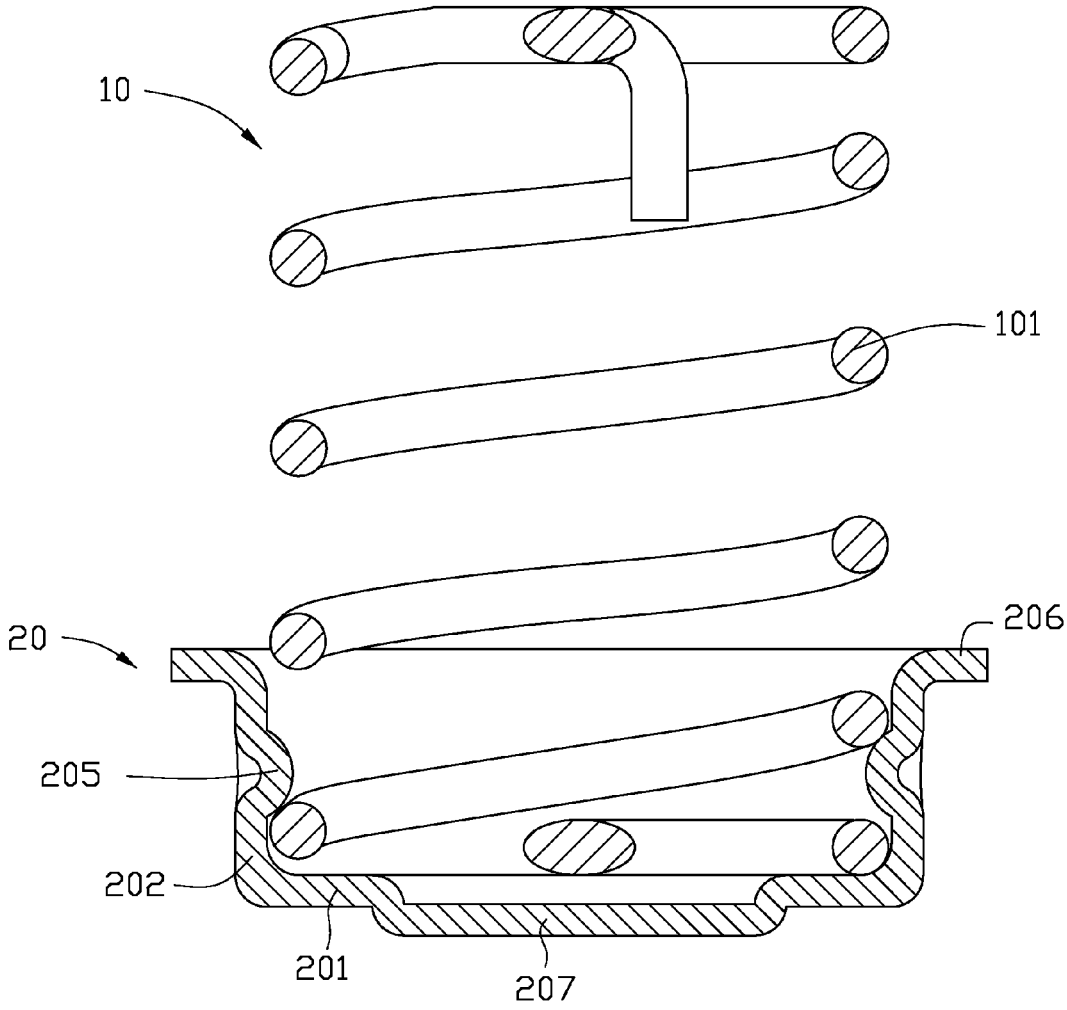
FIG. 2 is a side, cross-sectional view taken along line II-II of FIG. 1.

Referring to FIGS. 1 and 2, a battery connecting structure 100 in accordance with a first exemplary embodiment for achieving and maintaining battery contact within a battery-powered device is shown. The battery connecting structure 100 includes a contact spring 10 and a housing 20. The contact spring 10 includes a plurality of loops 101. Both ends of the contact spring 10 bend inward to avoid scratching a battery and the housing 20.

The housing 20 includes a base 201, a sidewall 202 extending around a periphery of the base 201. The base 201 is a circular plate forming a bottom protrusion 207 at a center of the base 201. In this embodiment, the housing 20 is made of phosphor bronze by punching and drawing processes. The bottom protrusion 207 is configured to match a bottom of a battery assembled cavity of the battery-powered device. The housing 20 further includes two retaining protrusions 205 formed at an inner surface on opposite sides the sidewall 202. Also, a flange 206 extends from a top of the sidewall 202. Each retaining protrusion 205 is substantially a hemispherical protrusion. One loop at an end of the contact spring 10 is tightly fixed between the base 201 and the retaining protrusions 205 such that the contact spring 10 is electrically fixed to the base 201 and the sidewall 202 of the housing 20. The contact spring 10 is not easily detached from the housing 20.

In this embodiment, each of the retaining protrusions 205 is a curved protrusion made by punching process. A maximum diameter of the contact spring 10 is equal to or larger than an inner diameter of the base 201. This configuration allows the contact spring 10 to be partially received in the housing 20. Preferably, a distance between the retaining protrusion 205 and the base 201 equals to a diameter of each loop 101 of the contact spring 10. In assembling, the end of the contact spring 10 is secured into a space defined between the retaining protrusions 205 and the base 201 to avoid detaching from the housing 20. It should be pointed out that the distance between the retaining protrusion 205 and the base 201 may be larger than the diameter of each loop so as to receive several loops 101 of the contact spring 10.

Figure 3:
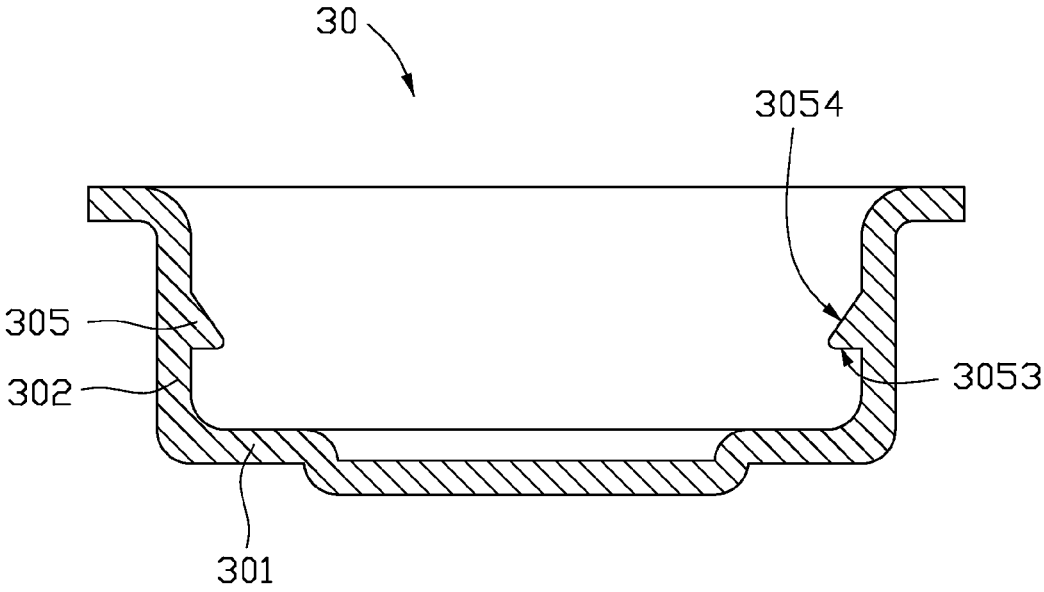
FIG. 3 is a side cross-sectional view of a housing of a battery connecting structure according to a second exemplary embodiment of the present invention.

Referring to FIG. 3, a housing 30 of a battery connecting structure in accordance with a second exemplary embodiment is shown. The housing 30 is similar in principle to the housing 20 of the first embodiment. However, two hooking protrusions 305 are formed at an inner surface of sidewall 302, replacing the retaining protrusions 205 of the housing 20. Each of the hooking protrusions 305 includes a blocking surface 3053 at a bottom of each hooking protrusion 305 and a steep inclined surface 3054 adjoining the blocking surface 3053. An acute angle is defined between the blocking surface 3053 and the steep inclined surface 3054. In this embodiment, the blocking surface 3053 is perpendicular to the inner surface of the sidewall 302. Alternatively, the blocking surface 3053 may be slanted to the inner surface of the sidewall 302, thereby forming an acute angle relative to the inner surface of the sidewall 302.

In assembling, a contact spring (not shown) is pressed into the housing 30 along the steep inclined surface 3054 of the hooking protrusion 305. A part of the contact spring deforms and passes through the hooking protrusion 305, and finally after passing through the hooking protrusion 305, the contact spring returns to a free state and blocked by the blocking surface 3053, such that the contact spring is electrically fixed to the housing 30.

Figure 4:
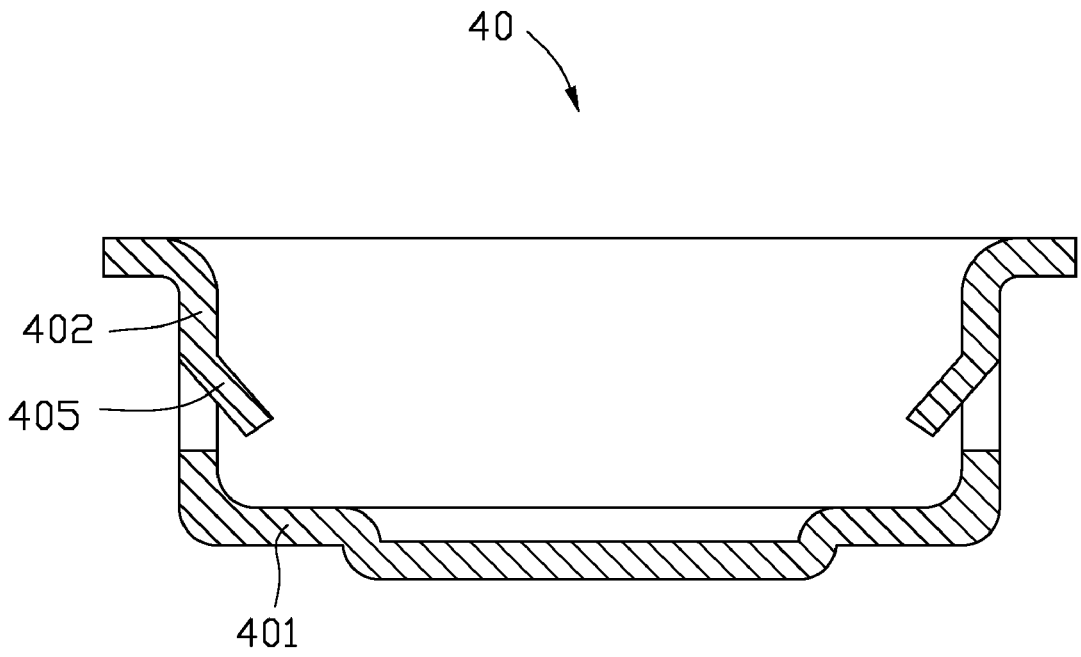
FIG. 4 is a side cross-sectional view of a housing of a battery connecting structure according to a third exemplary embodiment of the present invention.

Referring to FIG. 4, a housing 40 of a battery connecting structure in accordance with a third exemplary embodiment is shown. The housing 40 is similar in principle to the housing 20 of the first embodiment. However, two resilient sheets 405 defined at an inner surface of sidewall 402 replace the two retaining protrusions 205 of the housing 20. Each of the resilient sheets 405 extends from the inner surface of the sidewall 402 and inclines inwards. In assembling, a contact spring (not shown) is pressed into the housing 40, and a distal end of the resilient sheets 405 is compressed to move adjacent to the sidewall 402, and finally the contact spring is pressed to contact the base 401. When the contact spring returns to a free state, the contact spring is blocked by the resilient sheets 405, thereby the contact spring is electrically fixed to the housing 40.

Figure 5:
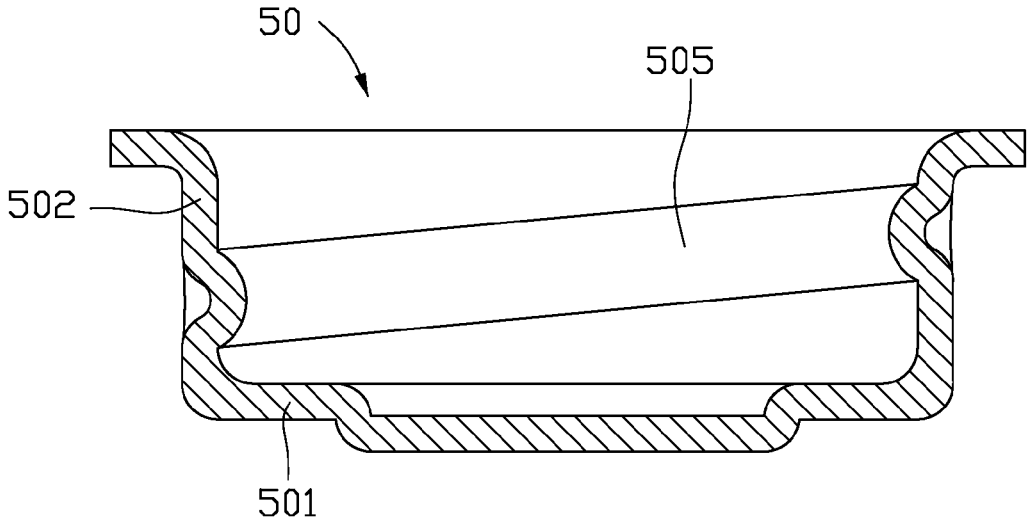
FIG. 5 is a side cross-sectional view of a housing of a battery connecting structure according to a fourth exemplary embodiment of the present invention.

Referring to FIG. 5, a housing 50 of a battery connecting structure in accordance with a fourth exemplary embodiment is shown. The housing 50 is similar in principle to the housing 20 of the first embodiment. However, a threaded protrusion 505 defined at an inner surface of sidewall 502 replace the two retaining protrusions 205 of the housing 20. The thread protrusion 505 extends around from a bottom portion of the sidewall 502 to a top portion of the sidewall 502. In assembling, a contact spring (not shown) is pressed into the housing 50, and finally after passing through the threaded protrusion 505, the contact spring returns to a free state and blocked by the threaded protrusion 505, such that the contact spring is electrically fixed to the housing 50.

Figure 6:
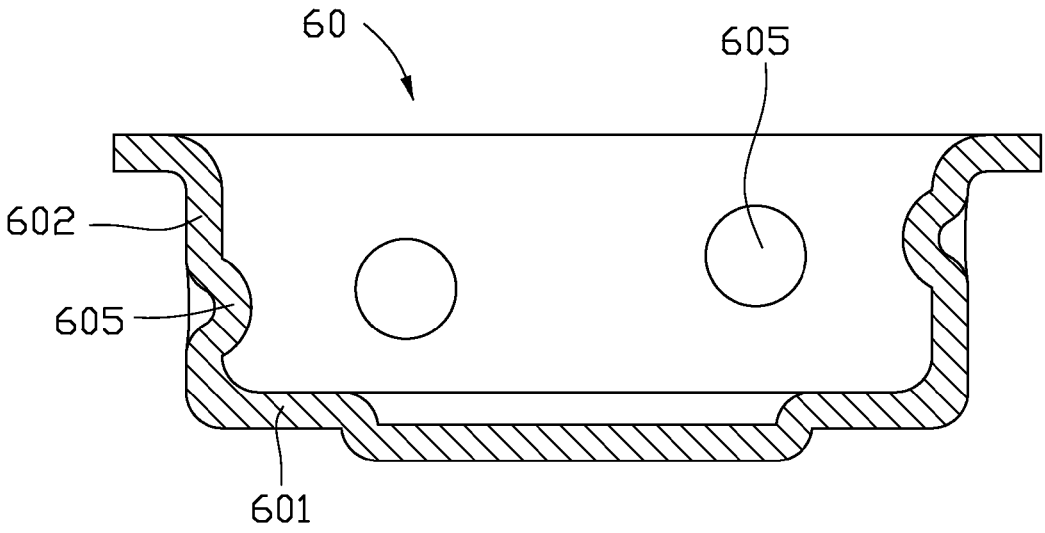
FIG. 6 is a side cross-sectional view of a housing of a battery connecting structure according to a fifth exemplary embodiment of the present invention.

Referring to FIG. 6, a housing 60 of a battery connecting structure in accordance with a fifth exemplary embodiment is shown. The housing 60 is similar in principle to the housing 20 of the first embodiment. However, the housing 60 includes a plurality of retaining protrusions 605 defined in an inner surface of sidewall 602 in random manner. In assembling, a contact spring (not shown) is pressed into the housing 60, and finally after passing through the retaining protrusions 605, an end of the contact spring contacts the base 601 and returns to a free state, and blocked by the retaining protrusions 605. Thus, the contact spring is electrically fixed to the housing 60.

Figure 7:
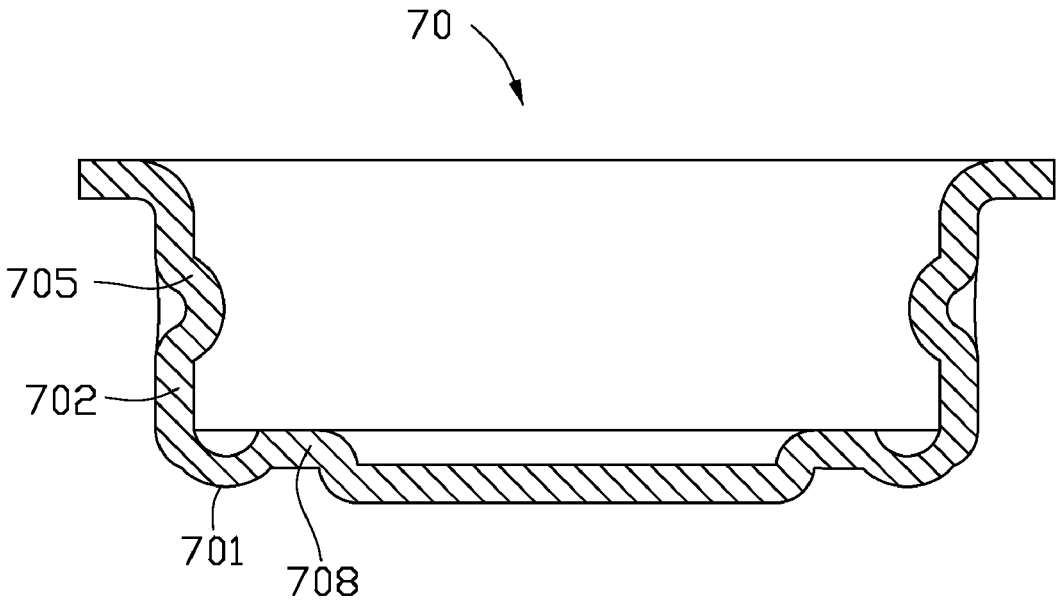
FIG. 7 is a side cross-sectional view of a housing of a battery connecting structure according to a sixth exemplary embodiment of the present invention.

Referring to FIG. 7, a housing 70 of a battery connecting structure in accordance with a sixth exemplary embodiment is shown. The housing 70 is similar in principle to the housing 20 of the first embodiment. The housing 70 includes two retaining protrusions 705 defined in an inner surface of sidewall 702. However, the housing 70 further includes a circular-depression 701 in a base 708 adjacent to the sidewall 702. The circular-depression 701 is configured for receiving an end of a contact spring (not shown). The circular-depression 701 has a semi-circular cross-section taken along a direction perpendicular to the sidewall 702 to match a shape of the loops of the contact spring.

In assembling, the contact spring is pressed into the housing 70 until the distal end of the loop of the contact spring is received in the circular-depression 701, and finally the contact spring returns to a free state, and is blocked by the retaining protrusions 705. Contact areas between the contact spring and the housing 70 are increased due to the circular-depression 701. This ensures the contact spring is electrically connected to the housing 70.

It should be pointed out that, the housings 20, 30, 40, 50, 60, 70 may be made of other metal materials such as magnesium alloy, aluminum alloy and so on. The housings 20, 30, 40, 50, 60, 70 may further include a coating formed on an inner surface of the sidewalls 202, 302, 402, 502, 602, 702 and the bases 201, 401, 601, 708 for increasing electronic conduction performance.

It is should be understood that, in the battery connecting structure, fixing portions including the retaining protrusion 205, 605, the hooking protrusion 305, the resilient sheet 405, and the thread protrusion 505 formed at the inner surface of the sidewall of the housing, can be replaced by any other elements that can block the contact spring.

Finally, while various embodiments have been described and illustrated, the invention is not to be construed as being limited thereto. Various modifications can be made to the embodiments by those skilled in the art without departing from the true spirit and scope of the invention as defined by the appended claims.

What is claimed is:

1. A battery connecting structure comprising:

a housing including a base, a sidewall extending around a periphery of the base, and at least one fixing portion defined at an inner surface of the sidewall away from the base; and a contact spring including a plurality of loops, wherein at least one of the loops of an end of the contact spring is fixed between the base and the at least one fixing portion, such that the end of the contact spring is electrically fixed to the base of the housing, and the base defines a bottom protrusion at a center thereof.

2. The battery connecting structure according to claim 1, wherein the housing is made of phosphor bronze.

3. The battery connecting structure according to claim 1, wherein the housing further comprise a flange extending from a top of the sidewall thereof.

4. The battery connecting structure according to claim 1, wherein a maximum diameter of the contact spring is equal to or larger than an inner diameter of the base.

5. The battery connecting structure according to claim 1, wherein the at least one fixing portion is a hooking protrusion, the hooking protrusion comprising a blocking surface at a bottom thereof and a steep inclined surface adjoining the blocking surface, the blocking surface and the steep inclined surface cooperatively defining an acute angle.

6. The battery connecting structure according to claim 1, wherein the at least one fixing portion is a resilient sheet, the resilient sheet extending from the inner surface of the sidewall and inclining inwards.

7. The battery connecting structure according to claim 1, wherein the at least one fixing portion is a threaded protrusion extending around from a bottom surface of the sidewall to a top portion of the sidewall.

8. The battery connecting structure according to claim 1, wherein the at least one fixing portion is a retaining protrusion, the retaining protrusion is a hemispherical protrusion.

9. The battery connecting structure according to claim 8, wherein a number of the retaining protrusions is many, and the retaining protrusions are located at the inner surface of the sidewall randomly.

10. The battery connecting structure according to claim 1, wherein the housing further comprises a circular-depression in the base and adjoining the sidewall for receiving the distal end of the contact spring.

11. The battery connecting structure according to claim 10, wherein the circular-depression has a semi-depression cross-section taken along a direction perpendicular to the sidewall.

12. A battery-powered device comprising:

a main body defining a battery assembled cavity, a battery connecting structure located at an end of the battery assembled cavity, the battery connecting structure including a housing including a base, a sidewall extending around a periphery of the base, and at least one fixing portion defined at an inner surface of the sidewall away from the base, and a contact spring including a plurality of loops, wherein at least one of the loops of an end of the contact spring is fixed between the base and the at least one fixing portion, such that the end of the contact spring is electrically fixed to the base of the housing, wherein the housing further comprises a circular-depression in the base and adjoining the sidewall for receiving the distal end of the contact spring.

13. The battery-powered device according to claim 12, wherein the at least one fixing portion is a hooking protrusion, the hooking protrusion comprising a blocking surface at a bottom thereof and a steep inclined surface adjoining the blocking surface, the blocking surface and the steep inclined surface cooperatively defining an acute angle.

14. The battery-powered device according to claim 12, wherein the at least one fixing portion is a resilient sheet, the resilient sheet extending from the inner surface of the sidewall and inclining inwards.

15. The battery-powered device according to claim 12, wherein the at least one fixing portion is a threaded protrusion extending around from a bottom surface of the sidewall to a top portion of the sidewall.

16. The battery-powered device according to claim 12, wherein the at least one fixing portion is a retaining protrusion, the retaining protrusion is a hemispherical protrusion.

17. The battery-powered device according to claim 16, wherein a number of the retaining protrusions is many, and the retaining protrusions are located at the inner surface of the sidewall randomly.

* * * * *